US006217459B1

(12) United States Patent
Purcell

(10) Patent No.: US 6,217,459 B1
(45) Date of Patent: Apr. 17, 2001

(54) PUTTER HEAD ASSEMBLY

(75) Inventor: Joseph E. Purcell, Clovis, CA (US)

(73) Assignee: Castlehawk, LLC, Clovis, CA (US)

( * ) Notice: Subject to any disclaimer, the term of this patent is extended or adjusted under 35 U.S.C. 154(b) by 0 days.

(21) Appl. No.: 09/244,682

(22) Filed: Feb. 4, 1999

(51) Int. Cl.[7] ..... A63B 53/02; A63B 53/04

(52) U.S. Cl. ..... 473/313; 473/340

(58) Field of Search ..... 473/340, 341, 473/342, 313, 314, 305, 324, 219, 325, 251; D21/736, 739, 740, 741, 742, 745

(56) References Cited

U.S. PATENT DOCUMENTS

| | | | |
|---|---|---|---|
| 1,250,296 | | 12/1917 | Fitzjohn et al. . |
| 1,703,199 | | 2/1929 | McClure . |
| 2,478,468 | | 8/1949 | Drake . |
| 2,486,952 | | 11/1949 | Kearsley et al. . |
| 2,809,838 | | 10/1957 | Oquist . |
| 3,042,405 | * | 7/1962 | Solheim . |
| 3,901,514 | * | 8/1975 | Priaulx . |
| 4,194,739 | * | 3/1980 | Thompson . |
| 4,326,716 | | 4/1982 | LaCoste . |
| 4,519,612 | * | 5/1985 | Tsao . |
| 4,936,582 | * | 6/1990 | Bernstein . |
| 5,267,733 | | 12/1993 | Szokola . |
| 5,382,019 | | 1/1995 | Sneed . |
| 5,445,382 | | 8/1995 | Pearce et al. . |
| 5,544,883 | | 8/1996 | Meyer . |
| 5,695,410 | * | 12/1997 | Brown . |

* cited by examiner

*Primary Examiner*—Sebastiano Passaniti
(74) *Attorney, Agent, or Firm*—Townsend and Townsend and Crew LLP

(57) ABSTRACT

A putter head assembly (2) includes a generally S-shaped hosel (4) having first and second ends (6, 8). A putter head (14) extends from the second end of the hosel. The hossel and putter head are made as a one-piece unit from a polymer material, typically a thermosetting resin. A golf ball-striking faceplate (16) is mounted to the putter head. These features combine to create a desirable feel to the golfer upon contact with the ball.

9 Claims, 2 Drawing Sheets

PUTTER HEAD ASSEMBLY

CROSS-REFERENCE TO RELATED APPLICATIONS

This is related to the following design patent applications: Putter Head Assembly, application Ser. No. 29/100,118, now U.S. Pat. No. Des. 430,245; Putter Head Face, application Ser. No. 29/100,117, now U.S. Pat. No. Des. 430,250; and Putter Head Hosel, application Ser. No. 29/100,119, now U.S. Pat. No. Des. 431,063.

BACKGROUND OF THE INVENTION

Conventional putters include a shaft having a handle at the upper end and putter head assembly at the lower end. The putter head assembly includes a putter head, which typically terminates in a generally vertical putter head face which contacts the ball, and a connecting section called a hosel. The hossel connects the putter head with the lower end of the shaft. Some putter head assemblies do not include the hosel, but rather the bottom or lower end of the shaft is attached directly to the putter head itself.

The desire for a putter which may help improve a golfer's game has generated a great number of innovative putter designs. Regardless of how many new putter designs are developed, they all seem to fall short in some category.

SUMMARY OF THE INVENTION

The present invention is directed to a putter head assembly which combines shape and material selection to provide a putter head which upon contacting the ball provides the golfer with both a metallic feel plus a softness not available with solid metal putter heads.

The putter head assembly includes a generally S-shaped hosel having first and second ends. The putter head extends from the second end of the hosel. The hossel and putter head are made as a one-piece unit from a polymer material, typically a thermosetting resin. A golf ball-striking faceplate is mounted to the putter head. These features combine to create a desirable feel to the golfer upon contact with the ball.

The polymer material is preferably a thermosetting resin material which permits a certain amount of flexing and give and thus, together with the shape of the hosel, provides the softness of feel upon contact with the ball as is desired. The faceplate is preferably a metal faceplate to provide the desirable metallic feel on initial ball contact. A skid plate is preferably mounted to the lower surface of the putter head both to provide abrasion resistance and to help provide the desired pendulum type action during the putting stroke. While the faceplate and skid plate may be connected, there is preferably a gap, filled with the polymer material, between them over a substantial portion of the lower leading edge of the putter head. The provision of the gap between the faceplate and the skid plate allows the faceplate to be bridged from heel to toe. This separation allows the faceplate's striking zone (sweet spot) to be free of metal support to enhance the softer feel on contact.

Other features and advantages of the invention will appear from the following description in which the preferred embodiments have been set forth in detail in conjunction with the accompanying drawings.

DESCRIPTION OF THE SPECIFIC EMBODIMENTS

Figure 1:
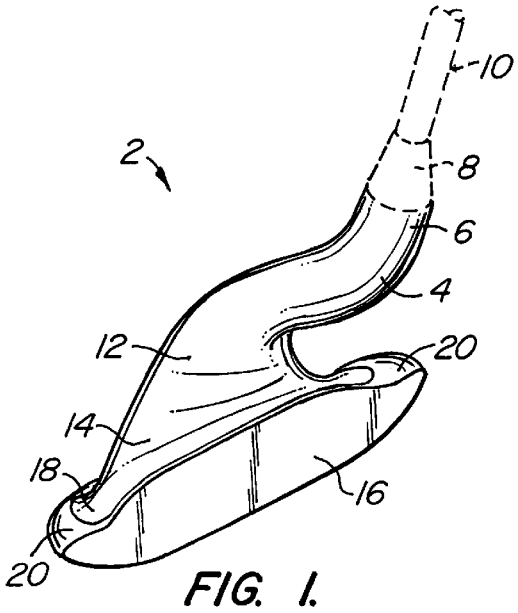
FIG. 1 is perspective view of a putter head assembly made according to the invention with the lower end of a putter shaft shown in broken lines for environmental purposes.
Figure 6:
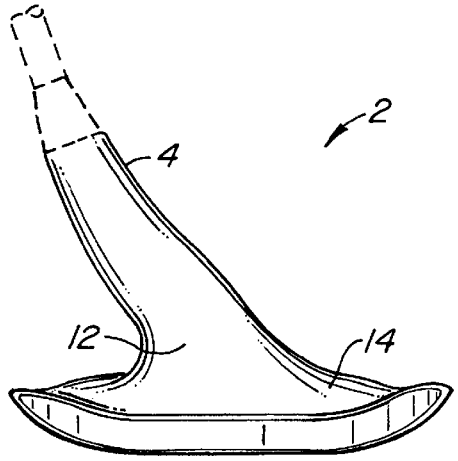
FIG. 6 is a rear elevational view thereof.
Figure 2:
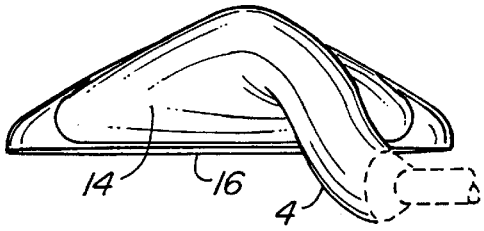
FIG. 2 is a top plan view thereof.
Figure 7:
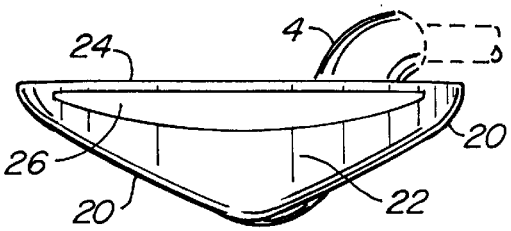
FIG. 7 is a bottom plan view thereof.
Figure 3:
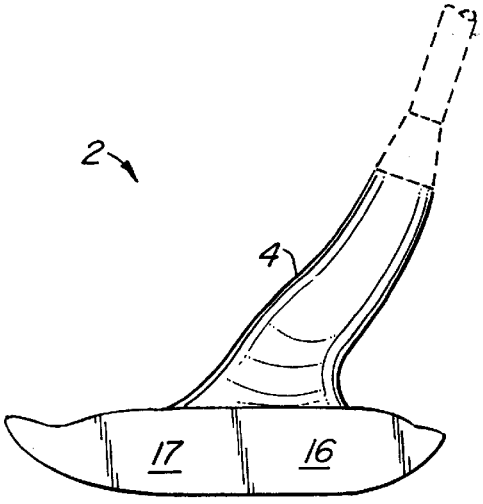
FIG. 3 is a front elevational view thereof.

FIG. 1 illustrates a putter head assembly 2 made according to the invention. Assembly 2 includes broadly a generally S-shaped hosel 4 having an upper end 6 attached to the lower end 8 of the putter shaft 10, a curving central portion 11 and a lower end 12 extending upwardly from a putter head 14. In addition to hosel 4 and putter head 14, putter head assembly 2 also includes a faceplate 16, preferably made of metal, such as stainless steel, copper, or aluminum, which defines a faceplate plane 17. Central portion 11 extends upwardly and forwardly from lower end 12 to lie generally vertically above faceplate plane 17. Metal faceplate 16 continues around the periphery 18 of putter head 14 as a metal skirt 20. Metal skirt 20 continues downwardly to form a metal skid plate 22. Skid plate 22 defines most or all of the lower or bottom surface of putter head assembly 2. Faceplate 16 defines the golf ball-contacting surface of putter head assembly 2. Surfaces 16, 22 are joined along a common edge 24. There is a gap 26 in metal skid plate 22 adjacent to common edge 24. This provides faceplate 16 with a little more flexibility than faceplate 16 would have if skid plate 22 extended all the way to faceplate 16 at common edge 24. This small increase in flexibility helps faceplate 16 to deflect slightly on impact with the golf ball, this provides the golfer with a better feel and potentially better control.

The generally S-shaped hosel 4 and putter head 14 are made as a one-piece unit of a polymer material. The polymer material is preferably a thermosetting epoxy resin. One such resin can be purchased from South Bay Plastics of Torrence, California as SPB 365A/365B.

One of the desirable attributes of putter head assembly 2 is that a desirable softness of feel be provided upon contact with the golf ball. It is believed that this desired softness of feel is in large part provided by the S-shaped hossel and the material from which the hosel and putter head is made.

Figure 4:
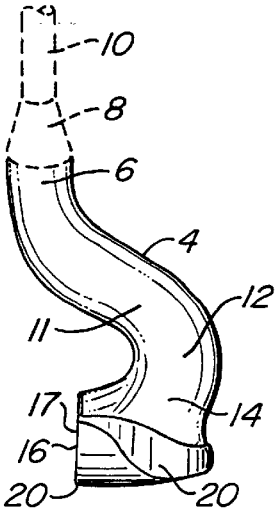
FIG. 4 is a right-side elevational view thereof.
Figure 5:
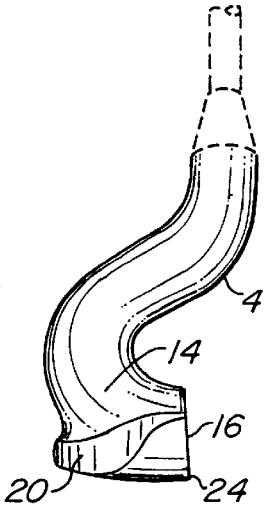
FIG. 5 is a left-side elevational view thereof.
Figure 8:
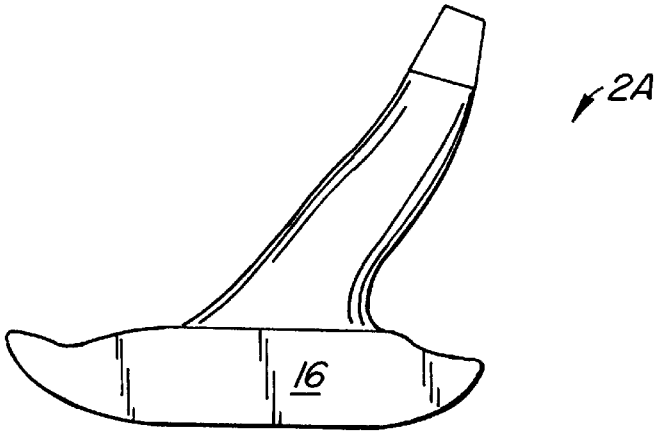
FIGS. 8 and 8A are two views of an alternative embodiment of the assembly of FIG. 1 with the hosel aligned with the faceplate.
Figure 8A:
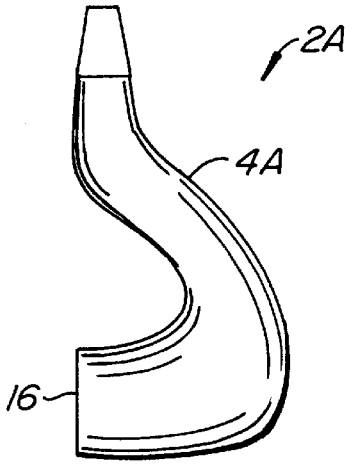
Figure 9:
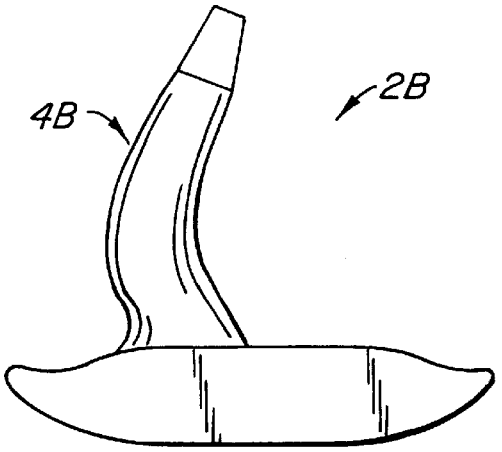
FIG. 9 is a further alternative embodiment in which the hosel is a reverse-angle hosel.

Generally S-shaped hosel 4 could have other generally S-shapes. For example, FIGS. 8 and 8A illustrate a putter head assembly 2A with a generally S-shaped hosel 4A which is generally aligned with faceplate 16. FIG. 9 illustrates a putter head assembly 2B with a reverse-angle generally S-shaped hosel 4B. Hossel 4B may be flush with faceplate 16 as in FIG. 8A or may be offset from faceplate 16 as in FIG. 4.

In lieu of a thermosetting epoxy resin, other appropriate polymer materials including polyester resin, acrylonitrile butadiene styrene, acetal, polycarbonate, polyvinyl chloride, polysulfone resin, fiberglass and vinyl esters could also be used. Also, materials having aligned or randomly-oriented fibers dispersed uniformly or non-uniformly to all or part of hossel 4 and putter head 14 may be suitable for use. While hosel 4 and putter head 14 are solid in the preferred embodiment, they include voids, which may or may not be filled with a foreign material. Skid plate 22 not only provides for scuff resistance, it also helps to provide the desired pendulum-like feel to the putter. Therefore, the thickness of skid plate 22 can be changed to modify the weight and pendulum-like feel for the putter. Heavy metallic plug inserts could also be used to increase or decrease the weight and pendulum effect of the putter.

Other modification and variation can be made to the disclosed embodiment without departing from the subject of the invention as defined in the following claims.

Any and all patents, applications and printed publications referred to above are incorporated by reference.

What is claimed is:

1. A putter head assembly, for use with a putter shaft having a putter shaft axis, comprising:

a generally S-shaped hosel having a curving central portion and first and second end portions, the hosel being mountable to the putter shaft at said first end portion;

a putter head extending from the second end portion of the hosel, the putter head and the hosel being a one-piece unit made from a polymer material; and a golf ball-striking faceplate mounted to the putter head, said faceplate having a ball-striking surface substantially parallel to the axis of the putter shaft and defining a faceplate plane;

the second end portion of the hosel extending upwardly from the putter head, the curving central portion extending upwardly and forwardly from the second end to lie generally vertically above the faceplate plane.

2. The putter head assembly according to claim 1 wherein the generally S-shaped hosel is a smoothly curving, generally S-shaped hosel.

3. The putter head assembly according to claim 1 wherein the polymer material is a thermosetting resin material.

4. The putter head assembly according to claim 1 wherein the faceplate is a metal faceplate.

5. The putter head assembly according to claim 4 further comprising a skid plate mounted to the putter head.

6. The putter head assembly according to claim 5 wherein the putter head comprises first and second surfaces extending from a common edge, said faceplate and skid plate constituting at least substantial portions of said first and second surfaces, respectively.

7. The putter head assembly according to claim 6 wherein said faceplate and skid plate are separated by a gap over a substantial portion of said common edge.

8. The putter head assembly according to claim 7 wherein said gap is along said second surface.

9. A putter head assembly, for use with a putter shaft having a putter shaft axis, comprising:

a smoothly-curving generally S-shaped hosel having a curving central portion and first and second end portions, the hosel being mountable to the putter shaft at said first end portion;

a putter head extending from the second end portion of the hosel, the putter head and the hosel being a one-piece unit made from a thermosetting resin material;

a metal golf ball-striking faceplate mounted to the putter head, said faceplate having a ball-striking surface oriented substantially parallel to the axis of the putter shaft and defining a faceplate plane;

the second end portion of the hosel extending upwardly from the putter head, the curving central portion extending upwardly and forwardly from the second end to lie generally vertically above the faceplate plane;

a metal skid plate mounted to the putter head;

the putter head comprising first and second surfaces extending from a common edge, said faceplate and skid plate constituting at least substantial portions of said first and second surfaces, respectively; and said faceplate and skid plate being separated by a gap along said second surface over a substantial portion of said common edge.

* * * * *